United States Patent [19]

Kishimoto

[11] Patent Number: 4,733,691

[45] Date of Patent: Mar. 29, 1988

[54] SOLENOID VALVE

[75] Inventor: Mitsufumi Kishimoto, Kobe, Japan

[73] Assignee: Konan Electric Co., Ltd., Nishinomiya, Japan

[21] Appl. No.: 47,229

[22] Filed: May 5, 1987

[51] Int. Cl.[4] ..... F15B 13/043

[52] U.S. Cl. ..... 137/596.16; 91/424; 137/596.18

[58] Field of Search ..... 91/424; 137/596.16, 137/596.18

[56] References Cited

U.S. PATENT DOCUMENTS

| | | | |
|---|---|---|---|
| 4,257,455 | 3/1981 | Cameron | 137/596.16 |
| 4,269,225 | 5/1981 | Ruchser et al. | 137/596.16 |
| 4,353,392 | 10/1982 | Ruchser et al. | 137/596.16 |
| 4,542,767 | 9/1985 | Thornton et al. | 137/596.16 |

FOREIGN PATENT DOCUMENTS

| | | | |
|---|---|---|---|
| 2732773 | 2/1979 | Fed. Rep. of Germany | 137/596.16 |
| 3421492 | 12/1985 | Fed. Rep. of Germany | 137/596.16 |

*Primary Examiner*—Gerald A. Michalsky
*Attorney, Agent, or Firm*—Jordan and Hamburg

[57] ABSTRACT

A solenoid valve including two valve members which are operable independently each other, wherein the inlet port and the outlet port may communicate only when both valve members are operated. The solenoid valve further includes annular opening and closing members slidably fitted around the respective first valve bodies of the two valve members and the synchronizing members. The synchronizing members are movable synchronized with each valve member and are coupled to the annular opening and closing member of other valve member.

1 Claim, 5 Drawing Figures

SOLENOID VALVE

FIELD OF THE INVENTION AND RELATED ART STATEMENT

The present invention relates to a solenoid valve including two valve members which are operable independently of each other wherein the inlet port and the outlet port may communicate only when both valve members are operated and the outlet port and the exhaust port are held in communication with each other when one of said valve members is inoperable, and more particularly to a solenoid valve which may be used as the activating valve for a pneumatic type clutch and brake for a press.

A construction of a solenoid valve to be used as an activating valve for a pneumatic type clutch and brake of a press is well known as illustrated in FIG. 1.

In FIG. 1, there are provided two openings 4 and 5 between a fluid supply chamber 2 to be connected to IN port p of a valve case 1 and a fluid chamber 3 to be connected to OUT port A and a first valve member adapted to open and close a first opening 4 and a second valve member adapted to open and close a second opening 5 are respectively provided. A discharge chamber 8 to be connected to a discharge port R communicates with the fluid chamber 3 through two openings 9 and 10.

The first valve member 6 includes a first valve body *6a* adapted to open and close the first opening 4, a second valve body *6b* adapted to open and close a third opening 9 and a piston *6c* which is subjected to pilot fluid pressure supplied from a pilot solenoid valve through a first pilot port PL1. Similarly, a second valve 7 includes a first valve body *7a*, a second valve body *7b* and a piston *7c*. The pilot fluid which will be pressurized against the piston *7c* is supplied from a second pilot port pL2.

In the inoperable condition, the first valve body *6a* of the first valve 6 is urged to close the first opening 4 and the first valve body *7a* of the second valve 7 is urged to close the second opening 5 respectively by the bias of the springs 11 and 12. At this instance, the second valve bodies *6b*, *7b* of the respective valve members are caused to open the third opening 9 and the fourth opening 10 respectively. In this condition or the waiting condition, the fluid or air pressure will not work against the outlet port A but the fluid present at the portion leading to the outlet port A will be discharged out of the discharge port R.

When two valve members are operated through operation of the pilot solenoid valve, the first valve bodies *6a*, *7a* are caused to open the openings 4, 5 while the second valve bodies *6b*, *7b* are caused to close the openings 9, 10. In this operable condition, the fluid will be supplied from IN port P to OUT port A and the discharge chamber 8 will be isolated from the fluid chamber 3.

As illustrated in FIG. 1, when one of the valve members, the first valve member 6 for instance, is operated but the other of the valve members, the second valve 7, is not operated, the fluid will be supplied to the fluid chamber 3 through the first opening 4. According to a prior art solenoid valve, however, since the flow passage area $S_1$ provided when both the first opening 4 and the second opening 5 are opened is so predetermined in relation to the flow passage area $S_2$ obtained when the third opening 9 and the fourth opening 10 that $S_1 < S_2$, a majority of the fluid will be discharged through the fourth opening which is made open with the second valve stem *7b* of the second valve 7 which is not operated. In other words, the clutch and brake may be operated only when two valves are activated simultaneously. In case that one of the valves may not be operated due to failure, no air pressure sufficient to operate the clutch and brake may be generated in the outlet port A.

Thus, according to a prior art solenoid valve, in order to minimize the pressure which may remain at the outlet port when one of the valve members is not operated, the supply of the fluid is restricted or so is the supply of the fluid through the first opening 4 and the second opening 5 as shown in FIG. 1 and to increase the discharge of the fluid on the contrary, the flow rate through the third opening and the fourth opening is made so large that operating pressure for the clutch and brake may not remain.

In this way, supply of the fluid is restricted even at a normal operating condition and as such the supply of working fluid is also reduced. Therefore, there has been such a problem that the entire valve members must be enlarged if the supply of fluid is to be increased.

OBJECT AND SUMMARY OF THE INVENTION

The present invention has as an object to provide a solenoid valve which is compact in size and capable of supplying a large quantity of fluid in order to eliminate the above-mentioned problems.

The above-mentioned object of the present invention has been attained by a solenoid valve characterized in including annular opening and closing members slidably fitted around the circumference of the first valve bodies of two valve members and synchronizing members interconnected respectively with said annular opening and closing members and adapted to work in synchronization with the movement of the other of the valve members, wherein at the position of said synchronizing member corresponding to the inoperable position of one of the valve members, the annular opening and closing member connected to that synchronizing member is in contact with the circumference of the first valve body of the other of the valve members and caused to seat against the opening which is to be closed or opened by said first valve body and keep that opening in a closed condition and at the position corresponding to the operable position, said annular opening and closing members are spaced from the openings so as to keep the relative openings open.

According to the present invention, movement of one of the valves members causes movement of the annular opening and closing member provided at the other valve member, and when one of the valve members is inoperable, even if the first valve body of the other valve member opens the relative opening, the annular opening and closing member keeps the opening and the first valve body closed. Accordingly, even if the opening of a valve is opened, the annular opening and closing member keeps the valve closed so that the fluid may be inhibited from flowing from the supply chamber into the fluid chamber. Only when both valves are operated together, the first valve bodies of both valves as well as the annular opening and closing members will be caused to move to open the openings completely. In this way, it is no more necessary to restrict the flow passage area at the openings between the supply chamber and the fluid chamber to be opened and closed by the first valve bodies, in consideration of the flow of the fluid to the discharge port as experienced in the prior art.

Further according to the present invention, even if one of the valve members may fail and become inoperable, supply of the fluid in the valve in an operable condition may be restricted, so that the pressure of the fluid remaining in the fluid chamber may be easily controlled. Furthermore, since the flow passage area at the openings is not restricted, the entire solenoid valve may be made compact.

DETAILED DESCRIPTION OF THE PREFERRED EMBODIMENT

The construction and operation of the present invention will be further explained by referring to an embodiment shown in the accompanying drawings.

Figure 1:
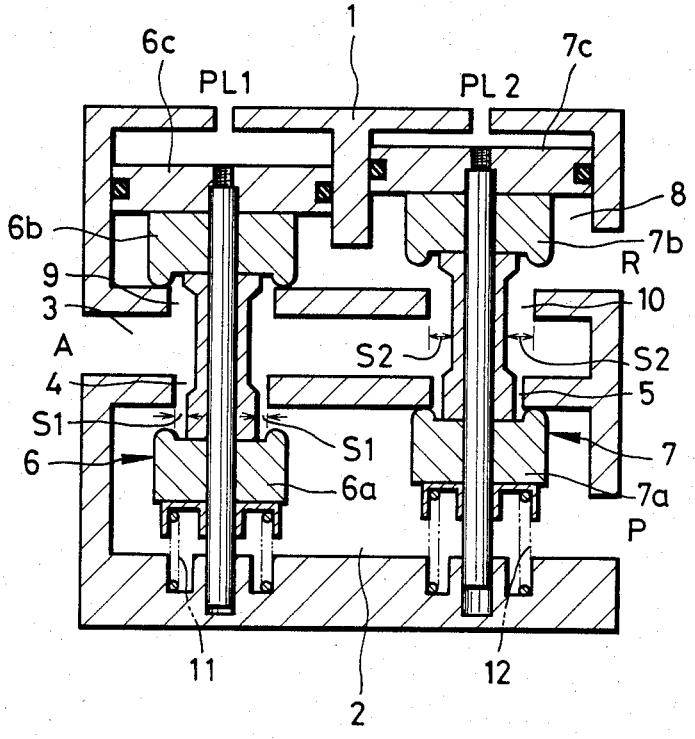
FIG. 1 PRIOR ART
FIG. 1 is the sectional view showing the main valve portion of the solenoid valve according to a prior art.
Figure 2:
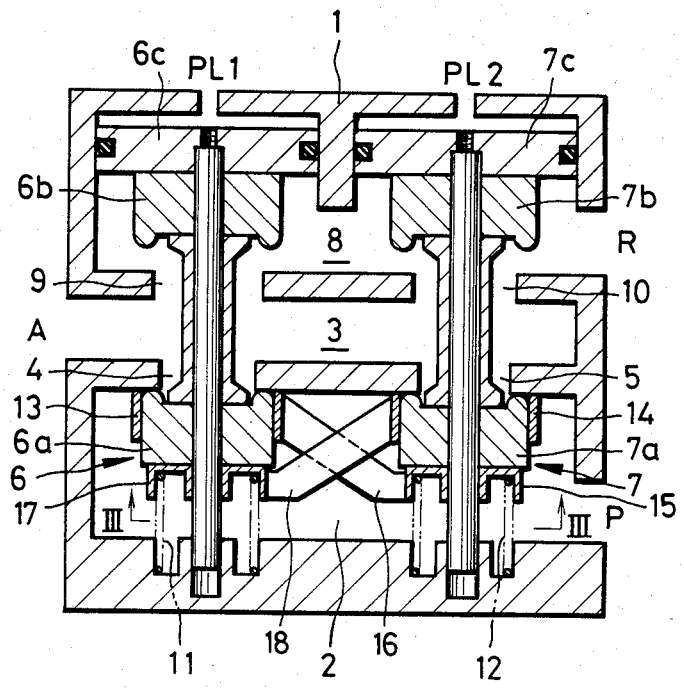
FIG. 2 is the sectional view showing the main valve portion of the solenoid valve according to the present invention in the inoperable condition.
Figure 3:
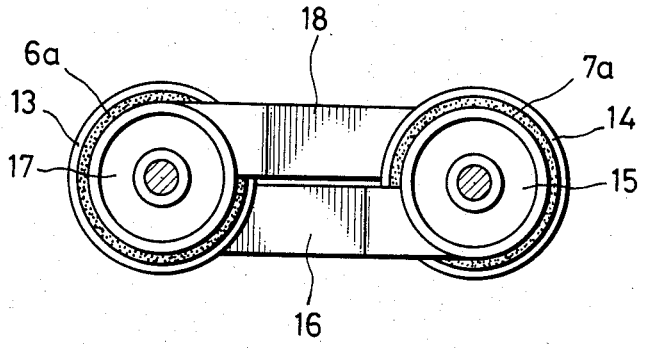
FIG. 3 is the sectional view taken along the line III—III in FIG. 2.

The constitution of the main valve portion with the pilot solenoid valve omitted for clarity is shown in FIG. 2 and FIG. 3.

In the main valve portion 1, there are provided a supply chamber 2 to be connected to IN port P, the fluid chamber 3 to be connected to OUT port A, and the discharge chamber 8 to be connected to the discharge port R. Two openings 4 and 5 are provided between the supply chamber 2 and the fluid chamber 3 while two openings 9 and 10 are provided between the fluid chamber 3 and the discharge chamber 8.

In the valve case 1, there are provided two sets of valve members, i.e., the first valve member 6 having the first valve body *6a* adapted to open and close the first opening 4 and the second valve stem *6b* adapted to close and open the third opening and the second valve 7 having the first valve body *7a* adapted to open and close the second opening 5 and the second valve body *7b* adapted to open and close the fourth opening 10.

Around the outer circumference of the first valve body *6a* of the first valve 6 is slidably fitted the first annular opening and closing member 13. Similarly the second annular opening and closing member 14 is slidably fitted around the outer circumference of the first valve body *7a* of the second valve 7. Said first annular opening and closing member 13 provided at the first valve member 6 is coupled to the first synchronizing member 15 in synchronization with movement of the second valve member 7 by means of a connecting member 16. The second annular opening and closing member 14 provided at the second valve member 7 is coupled to the second synchronizing member 17 in synchronization with movement of the first valve member 6 by means of a connecting member 18. With regard to construction of the first and second synchronizing members 15 and 17, any construction may be selected as long as they are able to follow the movement of the respective valve members 6, 7. In the illustrated embodiment, they are formed as the seats for springs 11, 12.

Since the first synchronizing member 15 is urged by the spring 12 toward the first valve body *7a* and the second synchronizing member 17 is urged by the spring 11 toward the first valve body *6a*, they are caused to reciprocate in accordance with the vertical movement of the first valve body *7a* and the first valve body *6a* respectively as illustrated in the drawings.

In FIG. 2 showing the waiting condition, since the pilot solenoid valves not shown are not operated and the first pilot port pL1 and the second pilot port pL2 are not supplied with the pilot fluid, the pistons *6c* and *7c* are not operated by the pilot pressure and the first valve member 6 and the second valve member 7 are activated respectively by the springs 11 or 12 in such a manner that the first valve bodies *6a*, *7a* are caused to seat against the openings to close them and the second valve bodies *6b*, *7b* are spaced from the openings 9, 10 to open them. In this condition, the fluid will not be supplied to the outlet port A which is then being discharged.

Figure 4:
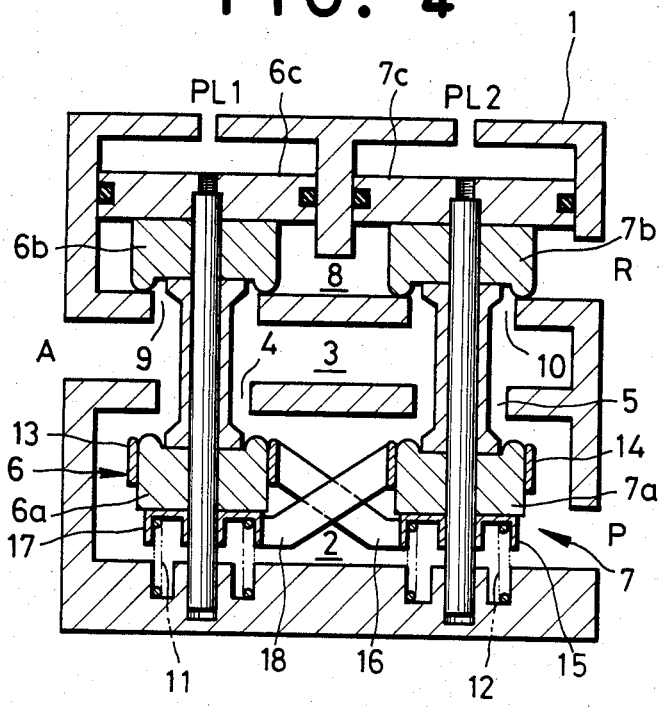
FIG. 4 is the sectional view corresponding to FIG. 2 but in operable condition.

When the pilot solenoid valve is activated and the pistons *6c*, *7c* are supplied with the pilot pressure, the operative condition is attained as shown in FIG. 4 and the first valve bodies *6a*, *7a* are caused to open the openings 4, 5 while the second valve bodies *6b*, *7b* are caused to close the openings 9, 10. Since the first synchronizing member 15 and the second synchronizing member 17 are caused to move along with the first valve bodies *7a*, *6a*, the first annular opening and closing member 13 is caused to move along with the first valve body *6a* of the first valve member 6 and the second annular opening and closing member 14 is caused to move along with the first valve body *7a* of the second valve member 7. Accordingly sufficient openings are provided between the first opening 4 and the first valve body *6a*, and between the second opening 5 and the second valve body *7a*.

Figure 5:
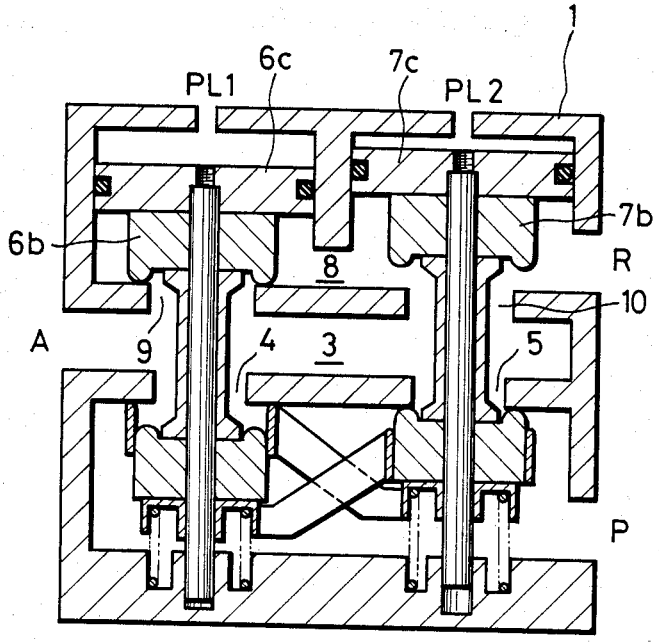
FIG. 5 is the sectional view corresponding to FIG. 2 but with one of the valves in the operable condition.

When one of the valve members is operated and the other is not operated due to the failure of the pilot solenoid valve and the main valve, or the first valve member 6 is operated as shown in FIG. 5, and the second valve member 7 is not operated, that is, in an incomplete operative condition, the second synchronizing member 17 is caused to move in accordance with movement of the first valve member 6 which is operating to allow the second annular opening and closing member 14 to be spaced from the second opening 5 and move in relation to the first valve body *7a* which is in inoperable condition. While the second annular opening and closing member 14 is spaced from the second opening 5, the first valve body *7a* of the second valve member 7 remains seated against the second opening 5, thus closing the second opening.

On the other band, since the second valve member 7 is in an inoperable condition, the first synchronizing member 15 is also kept in an inoperable condition. The first annular opening and closing member 13 is also kept in an inoperable condition. It is to be noted that the first annular opening and closing member 13 is seated against the first opening 4 in the inoperable condition. In this condition, even if the first valve member 6 is moved to the operative position, the first valve body *6a* is partly enclosed by the first annular opening and closing member 13 as shown in FIG. 5 and the first opening 4 is substantially isolated from the supply chamber 2. It can be seen therefore that even though the first opening 4 is not closed by the first valve body *6a*, the fluid may be prevented from flowing into the fluid chamber 3 through the first opening 4. It is further to be noted that even if the fluid may flow through the clearance which may be formed between the first valve body 6*a* and the first annular opening and closing member 13, the quanity of the fluid which may flow in such a way is so small that it will not generate any working pressure at the outlet port A. In other words, even if be valve is connected to the clutch brake of a press for instance, the press is maintained in such a condition that the clutch is OFF and the brake is ON, so that safety in respect of operation of a press may be assured.

What is claimed is:

1. A solenoid valve wherein two valve members are provided in a valve case including a fluid supply chamber to be connected to IN port, a fluid chamber to be connected to OUT port and a discharge chamber to be connected to a discharge port, said valve members respectively include the first valve bodies adapted to open and close the openings between said supply chamber and said fluid chamber and the second valve bodies adapted to open and close the openings between said fluid chamber and said discharge chamber, and when one of the first and second valve bodies of the respective valve members is open, the other may be switched to be closed, said solenoid valve being characterized in including annular opening and closing members slidably fitted around the respective first valve bodies of said two valve members and synchronizing members coupled to said annular opening and closing members and adapted to be synchronized with the movement of the other valve member and that said annular opening and closing members are so formed that they are spaced from the relative opening in the operative position and seated against the relative opening in the inoperative position to partly enclose the first valve body of the valve in the operative position and to allow the space between the relative opening and the first valve body to be isolated from the fluid supply chamber.

* * * * *